US011346191B2

(12) United States Patent
Sokolove et al.

(10) Patent No.: US 11,346,191 B2
(45) Date of Patent: May 31, 2022

(54) CLUSTER GUN SYSTEM

(71) Applicant: Hunting Titan, Inc., Pampa, TX (US)

(72) Inventors: Christopher Brian Sokolove, Midlothian, TX (US); Richard Wayne Bradley, Magnolia, TX (US); Adam Dyess, Houston, TX (US); Shane Matthew Wilson, Waxahachie, TX (US); Dale Langford, Pampa, TX (US); Ryan Bradley, Pampa, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 16/865,106

(22) Filed: May 1, 2020

(65) Prior Publication Data

US 2020/0270974 A1 Aug. 27, 2020

Related U.S. Application Data

(63) Continuation of application No. 16/510,481, filed on Jul. 12, 2019, now Pat. No. 10,677,026, which is a continuation of application No. PCT/US2019/015255, filed on Jan. 25, 2019.

(60) Provisional application No. 62/736,298, filed on Sep. 25, 2018, provisional application No. 62/627,591, filed on Feb. 7, 2018, provisional application No. 62/621,999, filed on Jan. 25, 2018.

(51) Int. Cl.

| | |
|---|---|
| ***E21B 43/117*** | (2006.01) |
| ***E21B 43/1185*** | (2006.01) |
| ***E21B 33/13*** | (2006.01) |
| ***E21B 43/116*** | (2006.01) |
| ***E21B 43/26*** | (2006.01) |
| ***E21B 43/263*** | (2006.01) |
| *E21B 33/12* | (2006.01) |

(52) U.S. Cl.

CPC ..... *E21B 43/117* (2013.01); *E21B 33/13* (2013.01); *E21B 43/116* (2013.01); *E21B 43/1185* (2013.01); *E21B 43/26* (2013.01); *E21B 43/263* (2013.01); *E21B 33/12* (2013.01)

(58) Field of Classification Search

CPC ..... E21B 43/117; E21B 43/1185; E21B 33/12
USPC ..... 175/4
See application file for complete search history.

(56) References Cited

U.S. PATENT DOCUMENTS

| | | | |
|---|---|---|---|
| 4,598,775 | A | 7/1986 | Vann et al. |
| 5,490,563 | A | 2/1996 | Wesson et al. |
| 8,336,635 | B2 | 12/2012 | Greenlee et al. |
| 2012/0080202 | A1 | 4/2012 | Greenlee et al. |
| 2013/0048375 | A1 | 2/2013 | Rodgers et al. |

(Continued)

FOREIGN PATENT DOCUMENTS

| | | | |
|---|---|---|---|
| WO | 2015102620 | A1 | 7/2015 |

OTHER PUBLICATIONS

Notification of transmittal of the international search report and the written opinion of the international searching authority, or the declaration, PCT/US2019/015255, dated Apr. 23, 2019, 13 pages.

(Continued)

*Primary Examiner* — Taras P Bemko
(74) *Attorney, Agent, or Firm* — Christopher McKeon; Jason Saunders; Saunders McKeon PLLC

(57) ABSTRACT

A method and apparatus for containing one or more shaped charges in a single plane, arrayed about the center axis of a gun body, and detonated from a single initiator in a shaped charge cluster assembly.

6 Claims, 13 Drawing Sheets

(56) References Cited

U.S. PATENT DOCUMENTS

| | | | |
|---|---|---|---|
| 2017/0028437 | A1 | 2/2017 | Holly et al. |
| 2017/0314373 | A9 | 11/2017 | Bradley et al. |

OTHER PUBLICATIONS

Office action dated Sep. 23, 2019 for U.S. Appl. No. 16/510,481, 16 pages.
Response to office action dated Sep. 23, 2019 for U.S. Appl. No. 16/510,481, filed Oct. 31, 2019, 13 pages.
Final Office action dated Jan. 2, 2020 for U.S. Appl. No. 16/510,481, 14 pages.
Response to final office action dated Jan. 2, 2020 for U.S. Appl. No. 16/510,481, filed Jan. 22, 2020, 9 pages.

CLUSTER GUN SYSTEM

RELATED APPLICATIONS

This application is a Continuation Application of Bypass Continuation application Ser. No. 16/510,481 filed Jul. 12, 2019 which claims priority to PCT/US19/15255, filed Jan. 25, 2019, U.S. Provisional Application No. 62/621,999, filed Jan. 25, 2018, U.S. Provisional Application No. 62/627,591, filed Feb. 7, 2018, and U.S. Provisional Application No. 62/736,298, filed Sep. 25, 2018.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Electric initiators are commonly used in the oil and gas industry for initiating different energetic devices down hole. Most commonly, 50-ohm resistor initiators are used. Other initiators and electronic switch configurations are common.

SUMMARY OF EXAMPLE EMBODIMENTS

An example embodiment may include a perforating gun assembly having a first cylindrical portion having a center axis with an outer surface, a protruding distal end having a first thru hole, a conical shaped end having a second thru hole, and at least one first half shaped charge receptacle, a second cylindrical portion along the center axis and proximate to the first cylindrical portion, having a second outer surface, a thru hole, and a conical shaped end, and at least one first half shaped charge receptacle, located tangential to the center axis with an apex end proximate to the center axis and an open end intersecting the outer surface.

An example embodiment may include a perforating gun assembly comprising a first cylindrical portion having a center axis with an outer surface, a protruding distal end having a first thru hole, a conical shaped end having a second thru hole, and at least one first half shaped charge receptacle, a second cylindrical portion along the center axis and proximate to the first cylindrical portion, having a second outer surface, a thru hole, and a conical shaped end, and at least one second half shaped charge receptacle, and at least one shaped charge disposed within the first half shaped charge receptacle and second half shaped charge receptacle, located tangential to the center axis with an apex end proximate to the center axis and an open end intersecting the outer surface.

A variation of the example embodiment may include a threaded cylindrical interface at the protruding distal end of the first cylindrical portion wherein the threaded cylindrical interface has a common axis with the center axis and includes the thru hole located therethru. It may include a contact retainer nut coupled to the threaded cylindrical interface. It may include a contact pin, having a substantially cylindrical shaped body and disposed partially within the thru hole, protruding from the threaded cylindrical interface, and restrained by the retainer nut. It may include a spring located within the thru hole and loading the contact pin against the retainer nut. It may include a contact strap passing over the first cylindrical portion and the second cylindrical portion and coupling to the spring disposed within the first thru hole and the conical shaped end of the second cylindrical portion. It may include a booster holder, having a substantially cylindrical shaped body and disposed partially within the second thru hole of the second cylindrical portion. The at least one shaped charge may be a plurality of shaped charges arrayed about the center axis of the first cylindrical portion. The at least one shaped charge may be adapted to perforate in a plane orthogonal to the center axis.

An example embodiment may include a method for loading a perforating gun comprising combining a first cylindrical half with a second cylindrical half to form a perforating shaped charge cluster, installing at least one shaped charge into the charge cluster, and installing the charge cluster into a perforating gun body, wherein the shaped charge cluster is snapped together using a plurality if tabs.

A variation of the example embodiment may include the gun body being coupled to a first tandem containing a detonator. The first charge cluster may be coupled to a second charge cluster. It may include coupling a contact piston, spring, and retainer nut to a first end of the first charge cluster. It may include electrically coupling the first end of the first charge cluster to the second end of the charge cluster. It may include lowering the perforating gun into a wellbore. It may include perforating a first perforation plane orthogonal to the wellbore. It may include fracturing the first perforation plane orthogonal to a wellbore.

An example embodiment may include method for perforating a well comprising combining a first cylindrical half with a second cylindrical half to form at least one perforating shaped charge cluster, installing at least one shaped charge into the charge cluster, installing the charge cluster into a perforating gun body, coupling the perforating gun body to addition tubulars to form a tool string, lowering the tool string into a predetermined location within a wellbore, and detonating at least one charge cluster at the first predetermined location.

A variation of the example embodiment may include the at least one shaped charge being a plurality of shaped charges. It may include at least one perforating shaped charge cluster being a plurality of charge clusters. It may include detonating at the least one charge cluster at a second predetermined location. It may include plugging the wellbore down hole from the first predetermined location. It may include plugging the wellbore down hole from the second predetermined location.

An example embodiment may include an apparatus for containing a shaped charge comprising a first cylindrical half having a thru hole center, first end, second end, and at least one half conical cutout arrayed about the center adapted to hold a shaped charge oriented to fire perpendicularly from the center axis, a second cylindrical half having a thru hole center, first end, second end, and at least one half conical cutout arrayed about the center adapted to hold a shaped charge oriented to fire perpendicularly from the center axis, wherein the first cylindrical half is coupled to the second cylindrical half.

A variation of the example embodiment may include a threaded cylindrical interface at a protruding distal end of the first cylindrical half wherein the threaded cylindrical interface has a common axis with the thru hole center axis. It may include a contact retainer nut coupled to the threaded cylindrical interface. It may include a contact pin, having a substantially cylindrical shaped body and disposed partially within the thru hole, protruding from the threaded cylindrical interface, and restrained by the retainer nut. It may include a spring located within the thru hole and loading the contact pin against the retainer nut. It may include a contact strap passing over the first cylindrical half and the second cylindrical half and coupling to the spring disposed within the first thru hole and the conical shaped end of the second cylindrical half. It may include a booster holder, having a substantially cylindrical shaped body and disposed partially within the second thru hole of the second cylindrical half. The at least one half conical cutout of the first cylindrical half may combine with the at least one half conical cutout of the second cylindrical half to form at least one cutout adapted to contain a shaped charge oriented to perforate orthogonal to a center axis of a wellbore. The at least one cutout may be a plurality of cutouts arrayed to form a perforation plane orthogonal to a center axis of a wellbore.

An example embodiment may include a perforating gun comprising an outer gun body, a first cluster charge holder, a plurality of shaped charges having an open end and an apex end, an initiating device, wherein the first cluster charge holder comprises a top end, a bottom end, a housing axis extending from the center of the top and an outer surface substantially parallel to the housing axis, a central bore extending from the top end of the charge housing along the housing axis, a plurality of charge cavities in the charge housing arranged radially about the housing axis, each of the charge cavities extending from a shaped charge aperture in the outer surface toward an apex end proximate the central bore, a plurality of priming holes in the charge housing connecting the central bore to the plurality of charge cavity apex ends, wherein the initiating device is inside the central bore of the first cluster charge holder and the plurality of shaped charges are inside the plurality of charge cavities, and wherein the explosive output of the initiating device detonates the shaped charges.

An example embodiment may include a second cluster charge holder, a plurality of shaped charges having an open end and an apex end, a detonation transfer device, wherein the second cluster charge holder comprises a top end, a bottom end, a housing axis extending from the center of the top and an outer surface substantially parallel to the housing axis, a central bore extending from the top end of the charge housing along the housing axis, a plurality of charge cavities in the charge housing arranged radially about the housing axis, each of the charge cavities extending from a shaped charge aperture in the outer surface toward an apex end proximate the central bore, a plurality of priming holes in the charge housing connecting the central bore to the plurality of charge cavity apex ends, wherein the detonation transfer device is inside the central bore of the second cluster charge holder and the plurality of shaped charges are inside the plurality of charge cavities of the first and second cluster charge holders, wherein an explosive output of the initiating device detonates the shaped charges in the first cluster charge holder and the detonation transfer device, and wherein an explosive output of the detonation transfer device detonates the shaped charges in the second cluster charge holder. The initiating device may include an addressable switch. The initiating device may include a detonator. The initiating device may include a percussion initiator. The detonation transfer device may include a booster. The detonation transfer device may include a detonating cord.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
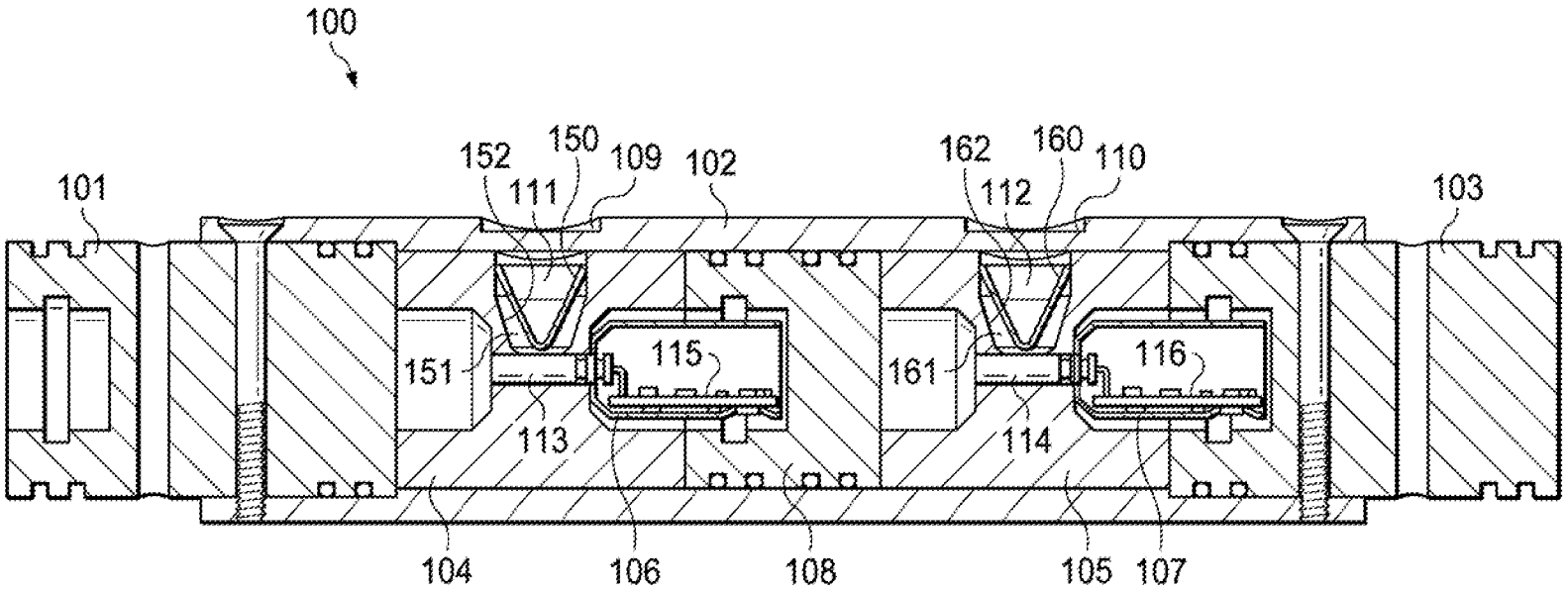
FIG. 1 shows an example embodiment of a side view of a cluster assembly.

An example embodiment is shown in FIG. 1. The example embodiment includes a short cluster gun 100 having a cylindrical gun body 102 with a center, an inner bore, an outer surface, a first end coupled to a bulkhead 101 and a second end coupled to a bulkhead 103. Within the gun body 102 is one or more charge clusters, in this case a first charge cluster 104 and a second charge cluster 105. Each charge cluster contains one or more shaped charges. In this example the first charge cluster 104 contains shaped charges 111 arrayed about the center and the second charge cluster 105 contains shaped charges 112 arrayed about the center. The first charge cluster 104 and the second charge cluster 105 are separated by an internal bulkhead 108. The outer surface of the gun body 102 has scallops that are aligned with each shaped charge. The scallops provide for a thinner body portion for the shaped charges to perforate through. In this case scallop 109 is aligned with shaped charge 111 and scallop 110 is aligned with shaped charge 112.

The first shaped charge 111 is located proximate to an initiating device 113, such as a detonator, which, when ignited, will fire the shaped charge 111. The initiating device 113 is coupled to an electronics board 115 housed within a detonator assembly 106, which is further housed within adjacent bores in the first charge cluster 104 and the internal bulkhead 108. The detonator assembly 106 may include an addressable switch. The first shaped charge 112 is located proximate to an initiating device 114, such as a detonator, which, when ignited, will detonate the shaped charge 112. The initiating device 114 is coupled to an electronics board 116 housed within a detonator assembly 107, which is further housed within adjacent bores in the second charge cluster 105 and the bulkhead 103. The detonator assembly 107 may include an addressable switch. The first shaped charge 111 has a liner 150 backed with explosive material 151 and enclosed within an inner surface 152 integral with the first charge cluster 104, where the first charge cluster 104 acts as the shaped charge housing. The first shaped charge 112 has a liner 160 backed with explosive material 161 and enclosed within an inner surface 162 integral with the first charge cluster 105, where the first charge cluster 105 acts as the shaped charge housing.

Figure 2:
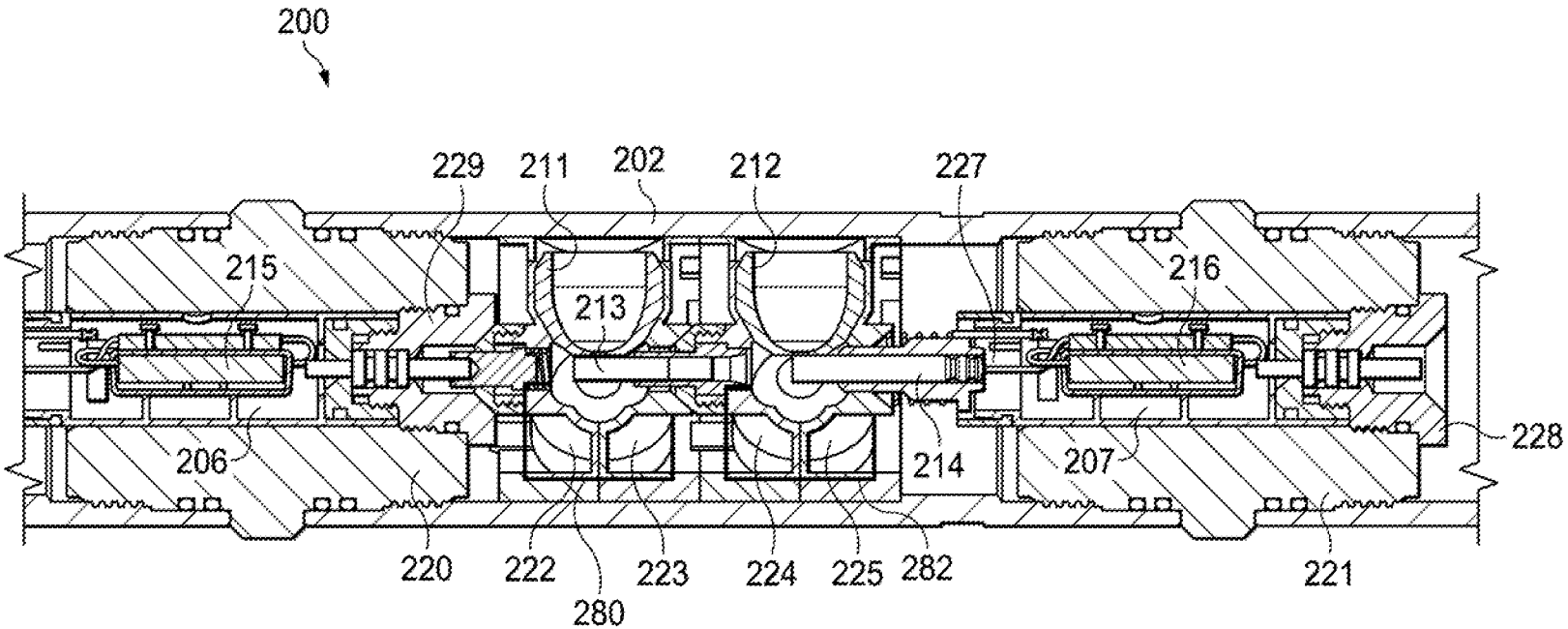
FIG. 2 shows an example embodiment of a side view of a cluster assembly.

An example embodiment of a cluster gun assembly 200 is shown in FIG. 2. The gun body 202 contains two sets of charge cluster halves that contain shaped charges forming a shaped charge cluster assembly 280. A first cluster half 222 and second cluster half 223 combine together within the gun body 202, they house shaped charge 211 which is located proximate to booster 213 located therethrough the center openings of the two charge halves 222 and 223. A third cluster half 224 and fourth cluster half 225 combine together within the gun body 202, they house shaped charge 212 and an initiating device 214 located therethrough the center openings of the two charge halves 224 and 225.

A first tandem 220 is coupled to the first end of the gun body 202. The tandem 220 has a hollow thru bore that is adapted to house a detonator assembly 206 that further contains a circuit board 215 for firing the shaped charges. The detonator assembly 206 may include an addressable switch. A bulkhead 229 is coupled to the tandem 220 and is further coupled to the detonator assembly 206.

A second tandem 221 is coupled to the second end of the gun body 202. The tandem 221 has a hollow thru bore that is adapted to house a detonator assembly 207 that further contains a circuit board 216 for firing the shaped charges. The detonator assembly 207 may include an addressable switch. A bulkhead 228 is coupled to the tandem 221 and is further coupled to the detonator assembly 207. The detonator assembly 207 is electronically coupled to a control fire cartridge 227. The control fire cartridge 227 is coupled to an initiating device 214 for detonating shaped charge 212 and booster 213, which would then detonate shaped charge 211.

Figure 3:
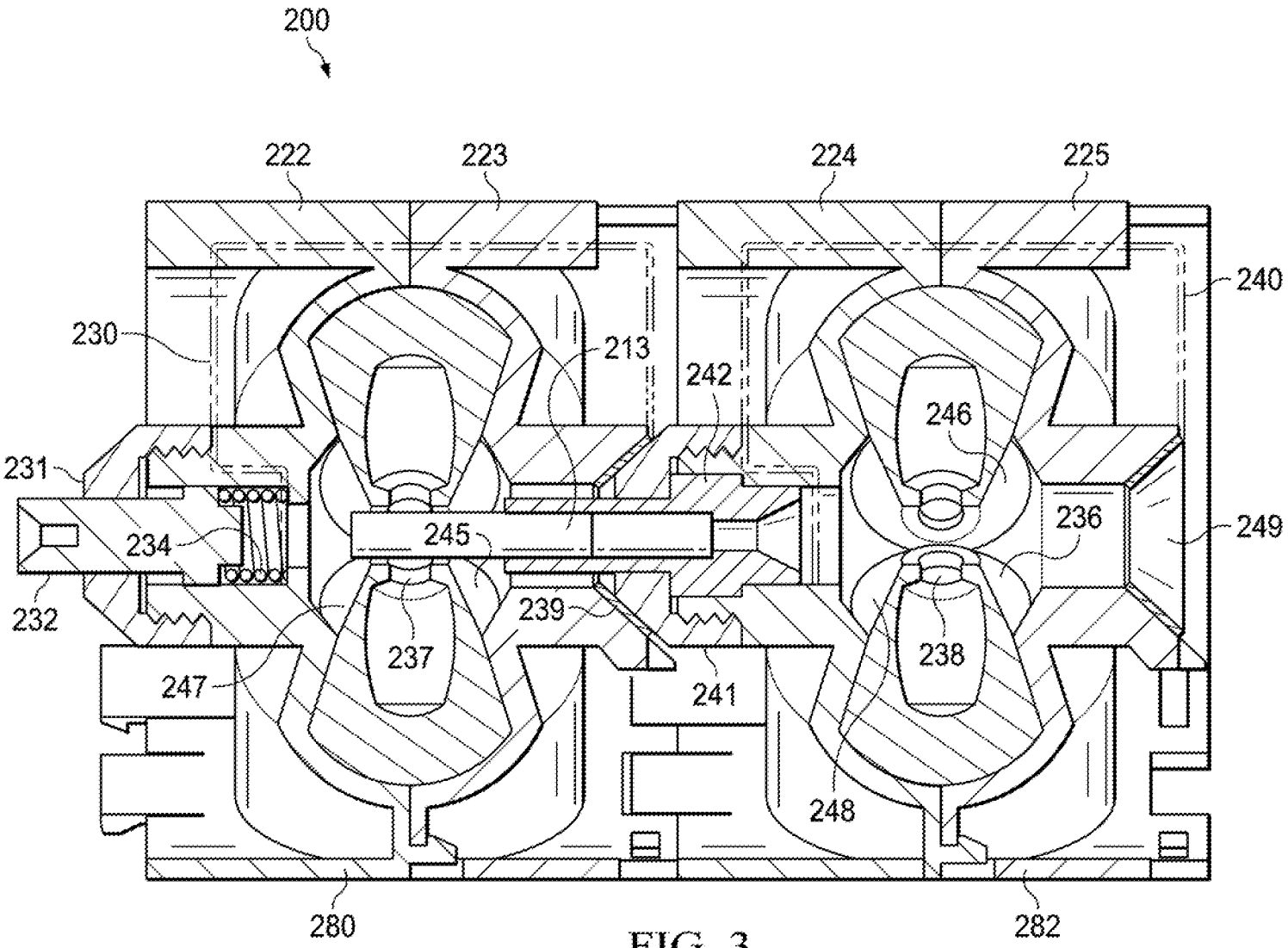
FIG. 3 shows an example embodiment of a side view of a cluster assembly.
Figure 4A:
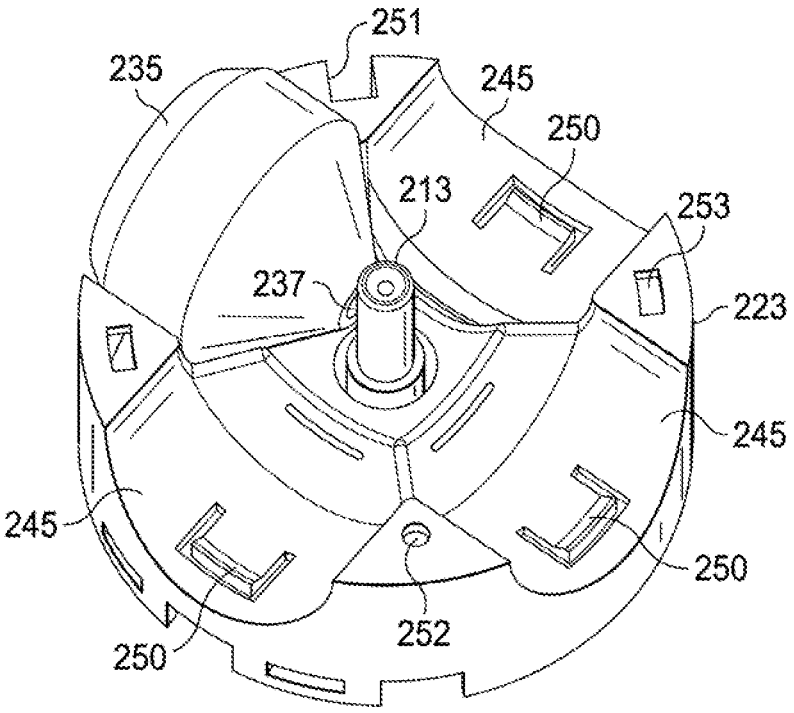
FIG. 4A-4D shows an example embodiment of a cluster assembly in various states of assembly.
Figure 4B:
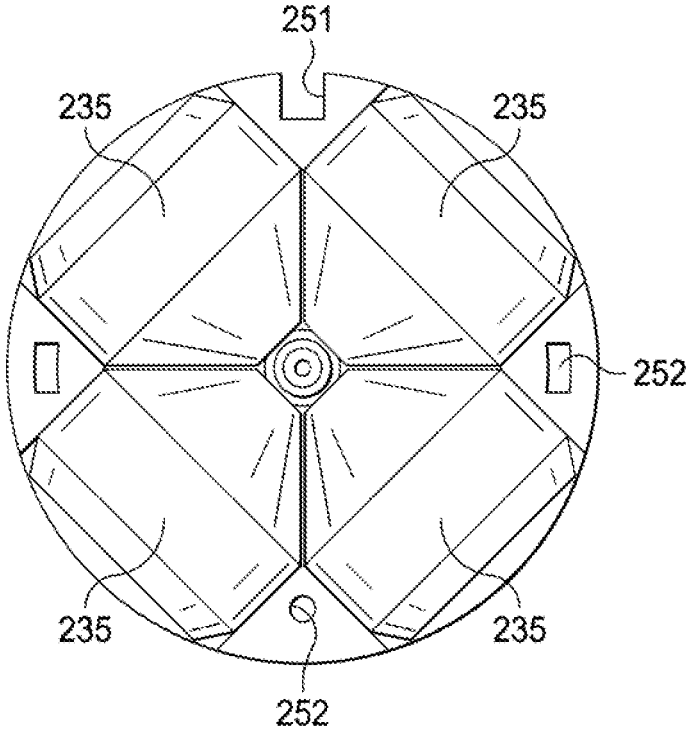
Figure 4C:
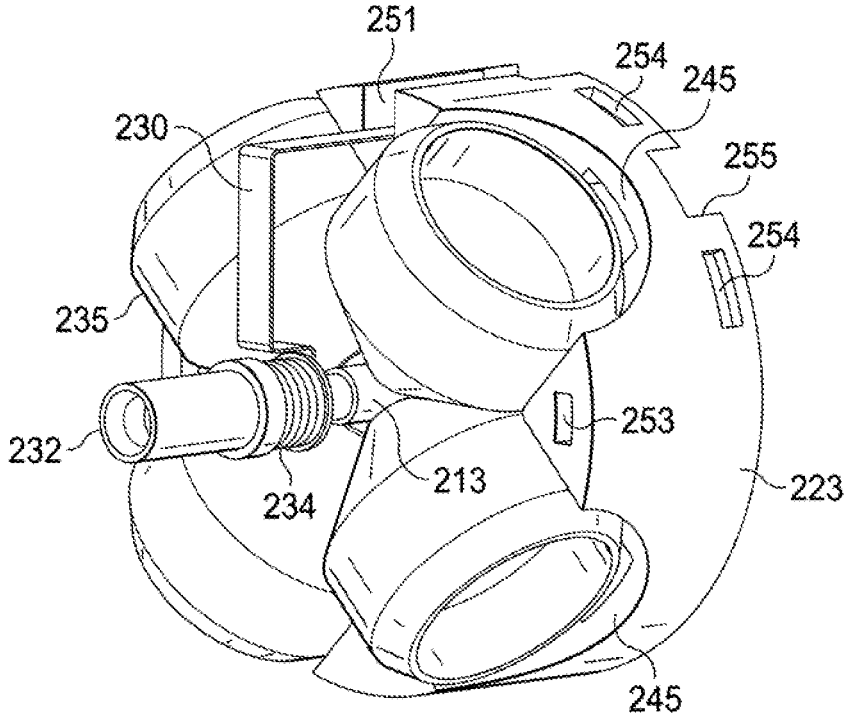
Figure 4D:
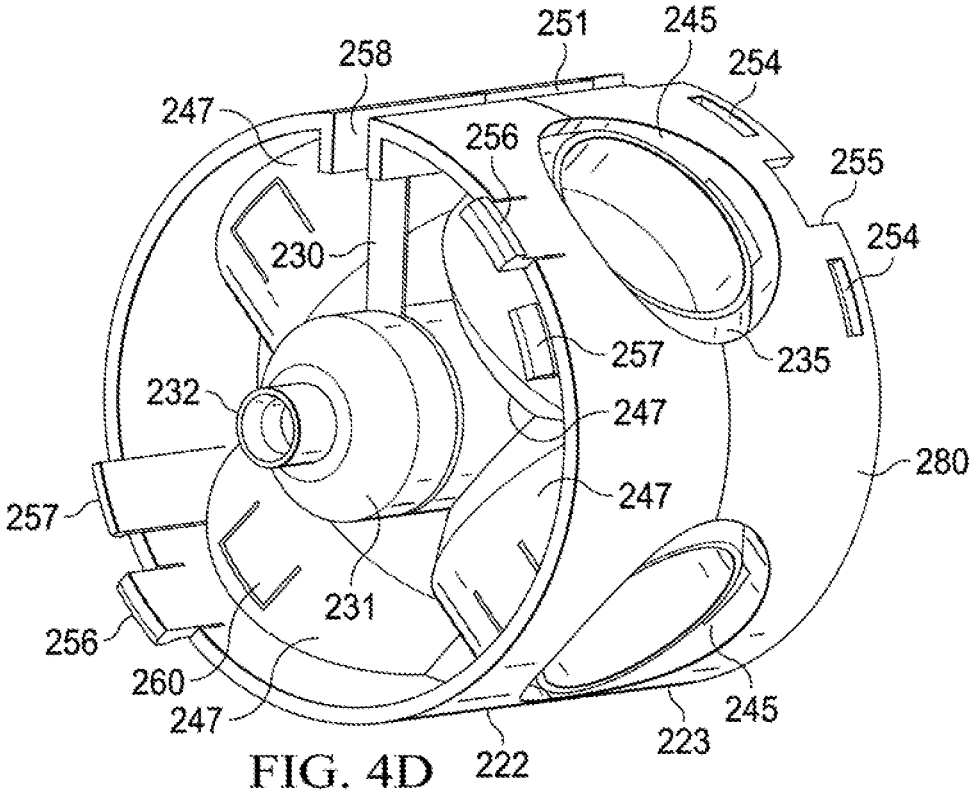

A close up view of an example embodiment of a cluster gun assembly 200 is shown in FIG. 3. The first cluster half 222 combines with the second cluster half 223 to form a shaped charge cluster assembly 280. The conical container portions 236 are adapted to slideably accept a shaped charge disposed therein. The conical container portions 245 and 247 are arrayed about the center of the first cluster half 222 and the second cluster half 223. The conical container portions 246 and 248 are arrayed about the center of the cluster halves 225 and 224, respectively. The cluster halves 222 and 223 have a thru opening adapted to allow booster 213 to slideably position at the end of the conical container portions 236. The booster 213 is held by a booster holder 242. Booster holder 242 is held in place against the third cluster half 224 via retainer nut 241. Conical container portions 245 and 247 combined have a thru hole 237, which allows the explosive output of the booster 213 to impact a shaped charge contained therein.

The third cluster half 224 combines with the fourth cluster half 225 to form a shaped charge cluster assembly 282. The conical container portions 246 and 248 are adapted to slideably accept a shaped charge disposed therein and are arrayed about the center of the cluster halves 224 and 225. The cluster halves 224 and 225 have a thru opening adapted to allow a booster to slideably position at the end of the array of conical container portions 236. Conical container portions 246 and 248 combined have a thru hole 238, which allows the explosive output of a detonator to impact a shaped charge contained therein. In these examples the first charge cluster assembly may be detonated by a detonator while each subsequent charge cluster assembly may be detonated by a booster transferring the original explosive output of the detonator. Other variations may be employed that are well known, such as using a detonator for each cluster assembly, or using a detonating cord running through the perforating gun from end to end. Each cluster assembly may have a unique addressable switch associated with its detonator.

A contact strap 230 is used to electrically couple the contact pin 232 and retainer spring 234 with the retainer nut 241 via conical contact portion 239. The cluster halves in this example are made out of an electrically insulating material. The contact strap 230 and 240 provide electrical communication through the cluster halves 222, 223, 224, and 225. Contact pin 232 is held in place against retainer spring 234 via retainer nut 231. The conical contact portion 249 may be coupled to an additional retainer nut.

Additional views of the cluster halves 222 and 223 are shown in FIGS. 4A, 4B, 4C, and 4D. Multiple shaped charges 235 can be contained within the cluster halves 222 and 223. The shaped charges 235 are retained in place using charge tabs 250. The booster 213 is aligned with the apex end 249 of each shaped charge 235. The contact pin 232 and spring 234 are electrically connected to the contact strap 230, which passes through the axial channel 251 and 258. The two cluster halves 222 and 223 are connected to each other via tabs and slots 253. The cluster assembly 280 can combine with other cluster assemblies via tabs 256 and 257 in conjunction with slots 254 and 255. Thru holes 252 provide a path for electrical or auxiliary wire pathways. The multiple tabs 254 allow for different alignment and orientation relationships between different cluster assemblies, such as either aligning the shaped charges in the different assemblies or offsetting the shaped charges a desired amount.

Referring to FIG. 4A-4D, the assembly of a tool string would include taking a fully assembled cluster halves 222 and 223 and installing the booster holder and booster 213. Then the contact strap 230, spring 234, and contact pin 232 would be installed and retained by the retainer nut 231, which threads directly onto the cluster assembly 280. Then shaped charges 235 would be inserted into the conical cavities 245 and 247 and retained by tabs 250. If an additional cluster assembly is to be coupled to the first cluster assembly 280 a booster may be installed into the contact pin 232.

Referring to FIG. 4A-4D, the disassembly of a cluster assembly 280 would include removing the retainer nut 231, then removing the contact pin 232, then remove the spring 234, then remove the contact strap 230, and then separate the cluster halves 222 and 223.

Figure 5A:
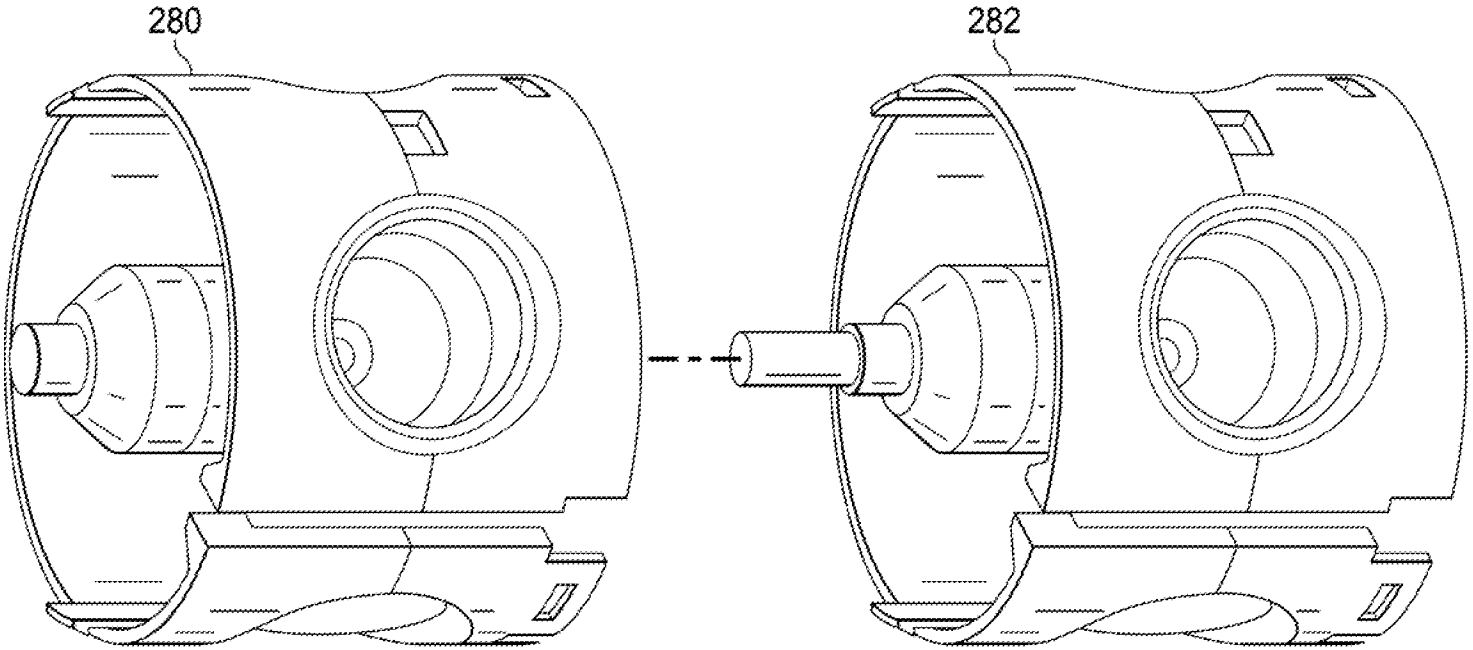
FIG. 5A-5C shows an example embodiment of a cluster assembly in various states of assembly.
Figure 5B:
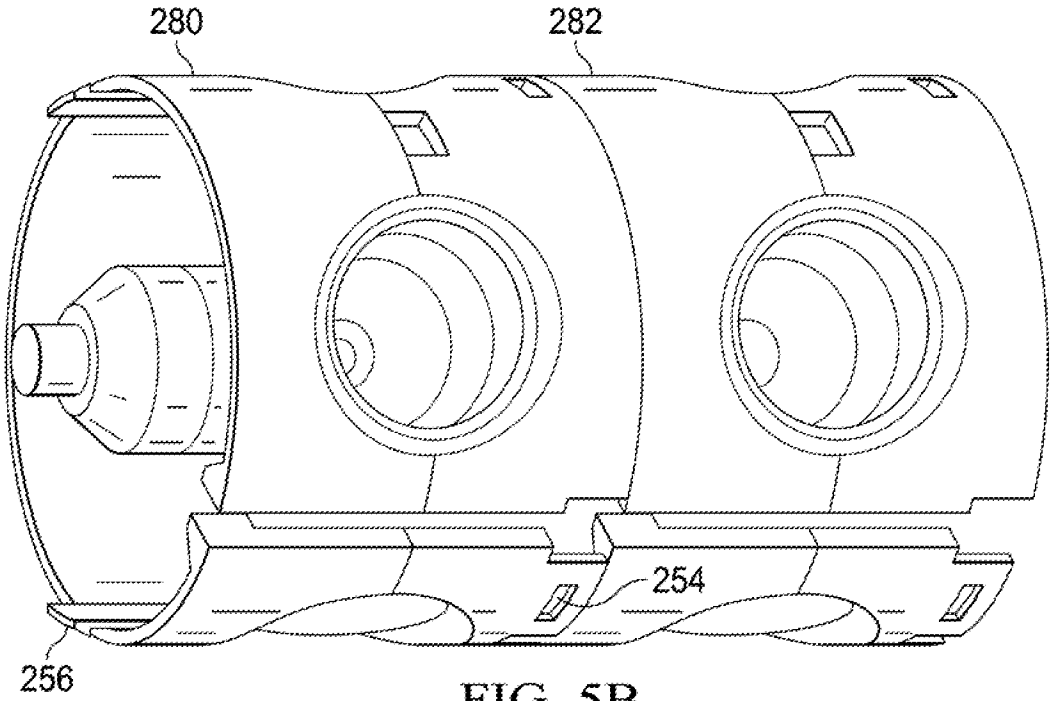
Figure 5C:
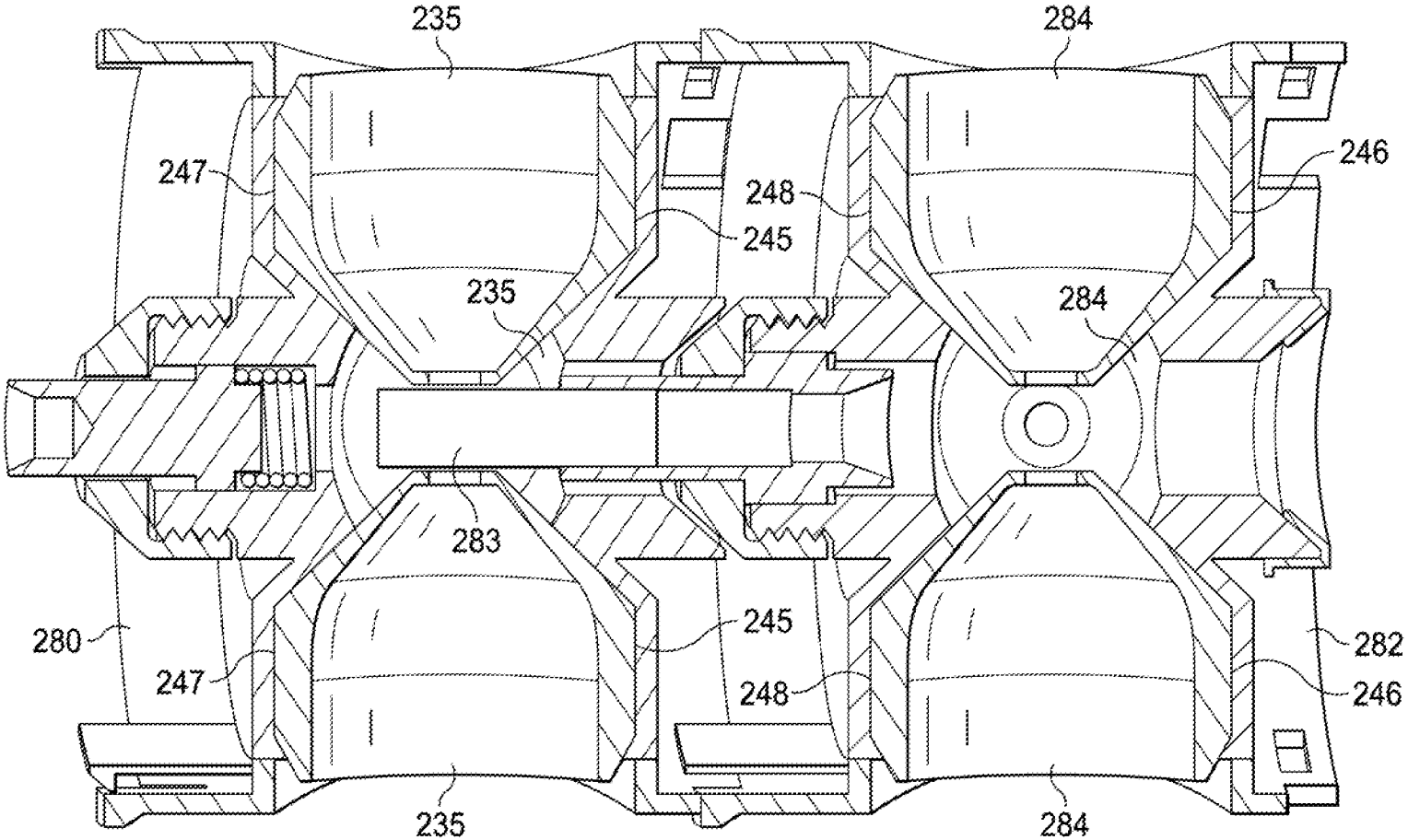

Two cluster assemblies 280 and 282 are installed together as shown in FIGS. 5A, 5B, and 5C and coupled using tabs and tab slots 254. The booster 283 is aligned with the shaped charges 235 in the cluster assembly 280. Tabs 256 provide for engaging with additional cluster assemblies or for engaging the inner threaded portion of a gun housing. In FIG. 5C conical cavities 245 and 247 combine to form a cavity adapted to accept and retain a shaped charge 235. Conical cavities 248 and 246 combine to form a cavity adapted to accept and retain shaped charges 284.

Figure 6A:
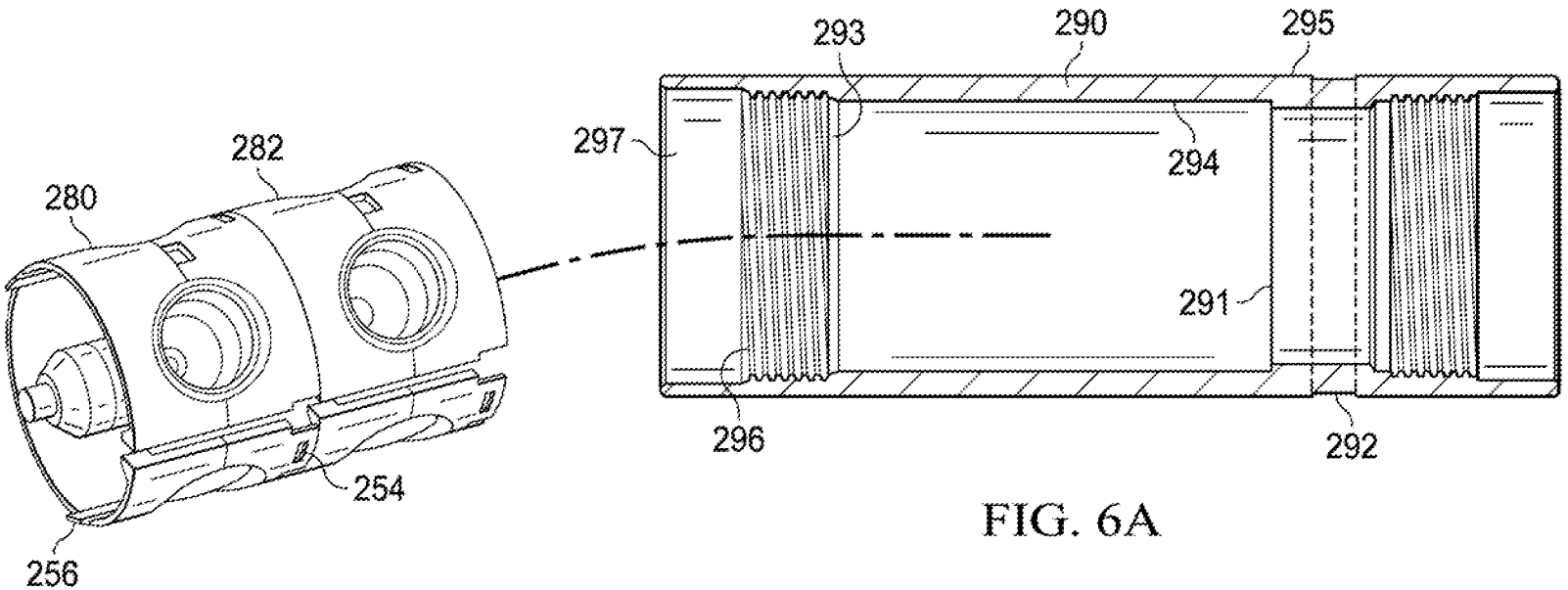
FIG. 6A-6B shows an example embodiment of a cluster assembly in various states of assembly.
Figure 6B:
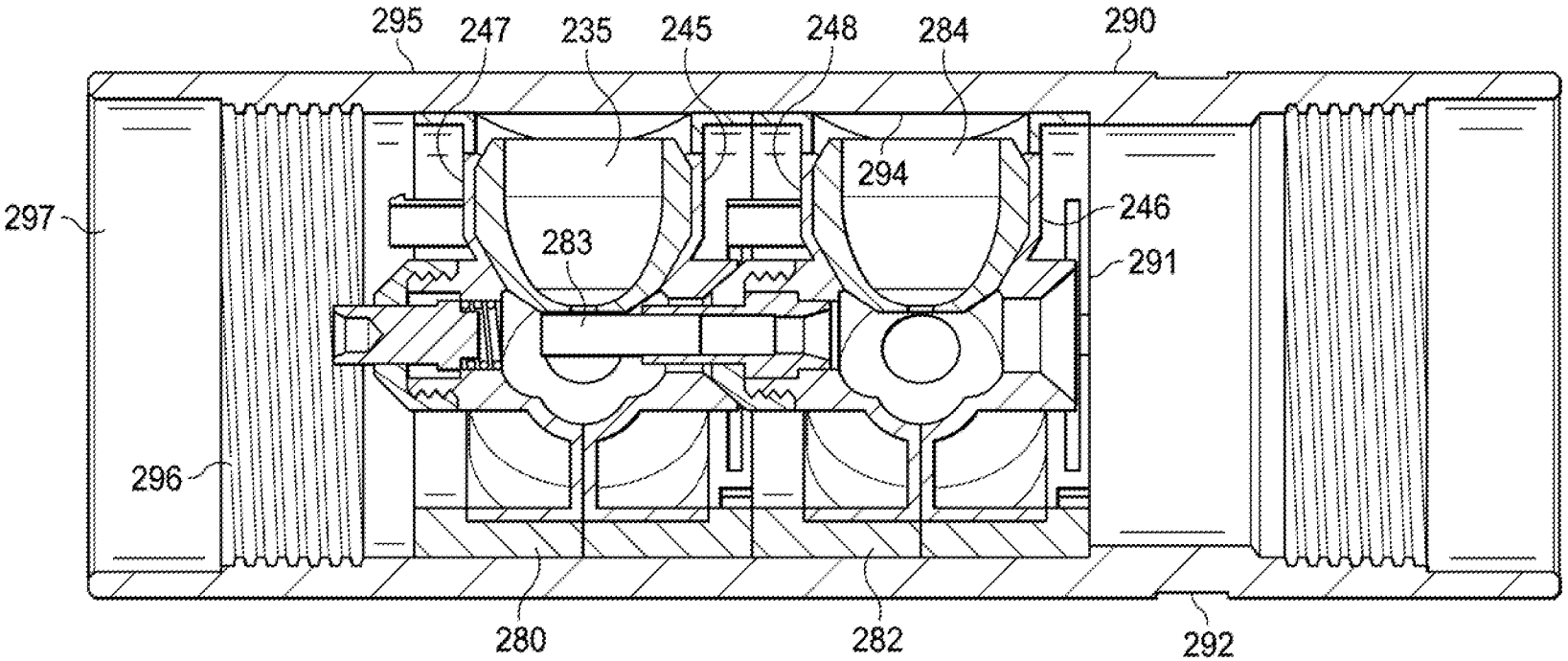

Referring to FIGS. 6A and 6B, two cluster assemblies 280 and 282 are combined using tabs and tab slots 256. The two cluster assemblies 280 and 282 are then slideably positioned into gun body 290. Gun body 290 has an inner surface 294 and an outer surface 295. In this example the gun body 290 has no scallops, but it may have a scalloped outer surface in some embodiments. The inner surface 295 has a shoulder 291 that provides a hard stop for the cluster assemblies 280 and 282 when they are inserted. The tabs 298 will engage with the threads 297 to provide resistance against the assemblies falling out of the gun body. A snap ring groove 293 also provides an additional mechanical mechanism to keep the cluster assemblies 280 and 282 in place. External groove 292 provides identification during assembly of a tool string of the orientation of the gun body 290. Perforating charges 235 are contained in the conical cavities 245 and 247, arrayed about the centerline of the cluster assembly 280. Perforating charges 284 are contained in the conical cavities 246 and 248, arrayed about the centerline of the cluster assembly 282. Booster 283 is already inserted and an initiator device will be inserted into the cluster assembly 282 when the firing control cartridge is inserted into the gun body 290. Threads 296 can be engaged with tabs 256.

Figure 7:
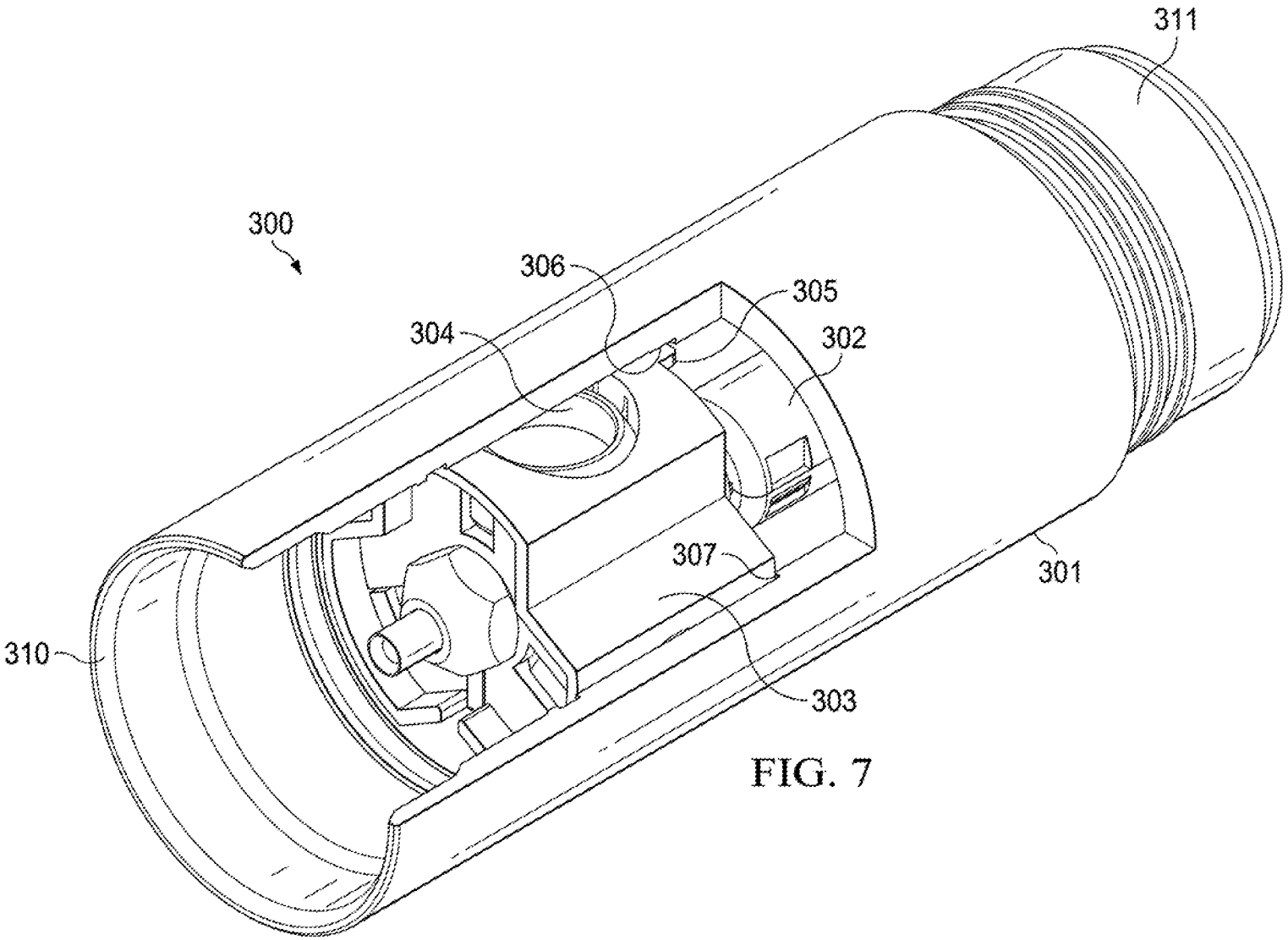
FIG. 7 shows a cutaway view of an example embodiment of a cluster assembly.

Referring to FIG. 7, a perforating gun assembly 300 includes a gun body 301 having a box end 310 and pin end 311 with a cluster assembly 303 slideably engaged therein. The shoulder 307 determines how far into the gun body 301 the cluster assembly 303 can slide within. The key 305 and broach 306 feature are used to control the orientation of the cluster assembly within the gun body 301. A shaped charge 304 is shown inserted into one of the phases of the cluster assembly and a detonator assembly 302 is shown.

Figure 8A:
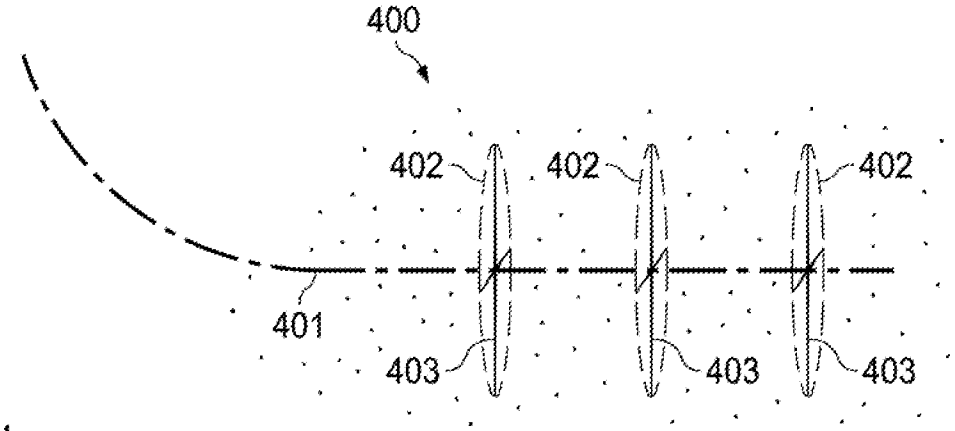
FIG. 8A-8H depicts different types of perforation patterns in a downhole formation that are possible with the example embodiments.
Figure 8B:
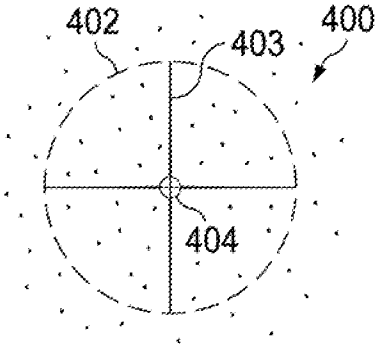

Referring to FIG. 8A-8H, a series of perforation configurations in a formation 400 are shown using the example embodiments. In FIGS. 8A and 8B a typical horizontal wellbore axis 401 is perforated. There are three perforation planes 402 that are orthogonal to the wellbore axis 401. Each perforation plane 402 has four perforation jets 403 that are evenly phased 90 degrees about the horizontal portion of the wellbore axis 401. Perforation jets 403 are orthogonal to the wellbore axis 401. FIG. 8B shows view of the perforation plane 402 with perforation jets 403 exiting the wellbore 404 and entering the formation 400. There may be more than or less than three perforation planes 402. The perforation planes 402 may be located at various distances from each other. There may be more than or less than four perforation jets 403 in each plane.

Figure 8C:
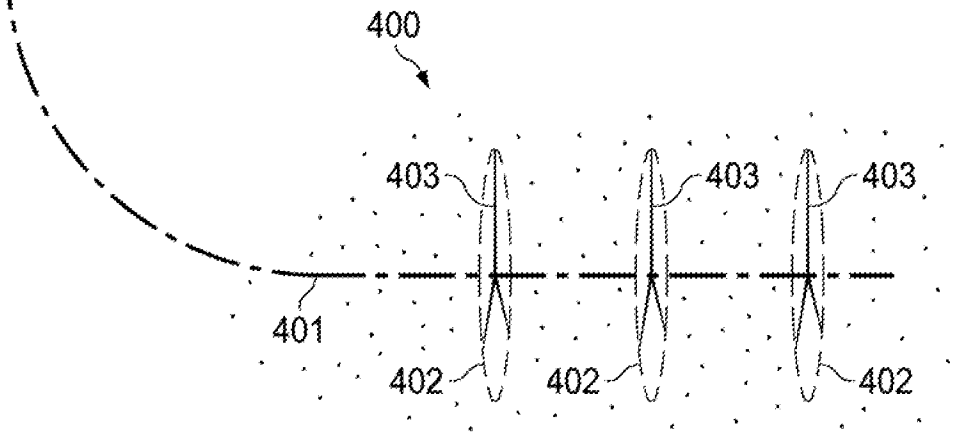
Figure 8D:
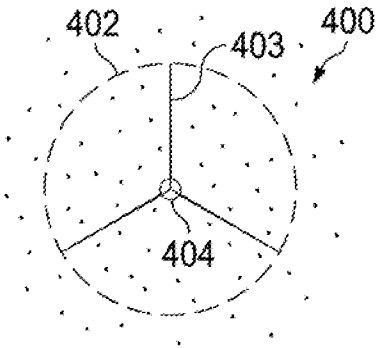

In FIGS. 8C and 8D a typical horizontal wellbore axis 401 is perforated. There are three perforation planes 402 that are orthogonal to the wellbore axis 401. Each perforation plane 402 has three perforation jets 403 that are evenly phased 120 degrees about the horizontal portion of the wellbore axis 401. FIG. 8D shows a view of the perforation plane 402 with perforation jets 403 exiting the wellbore 404 and entering the formation 400. Perforation jets 403 are orthogonal to the wellbore axis 401. There may be more than or less than three perforation planes 402. The perforation planes 402 may be located at various distances from each other. There may be more than or less than three perforation jets 403 in each plane.

Figure 8F:
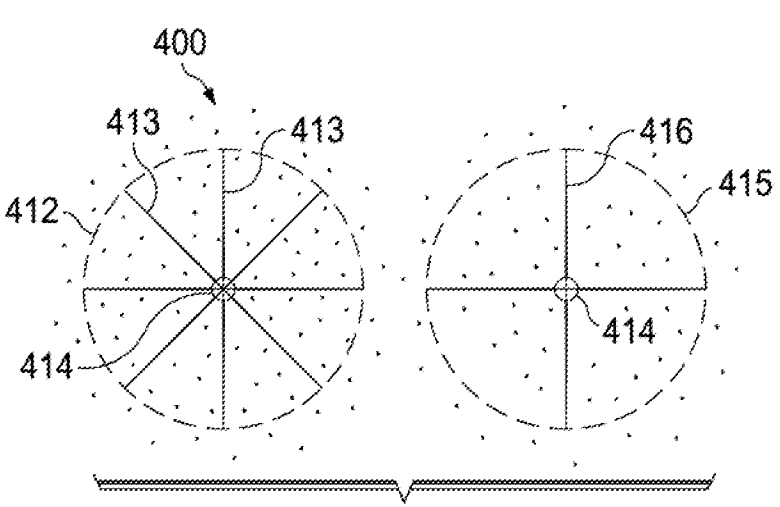
Figure 8E:
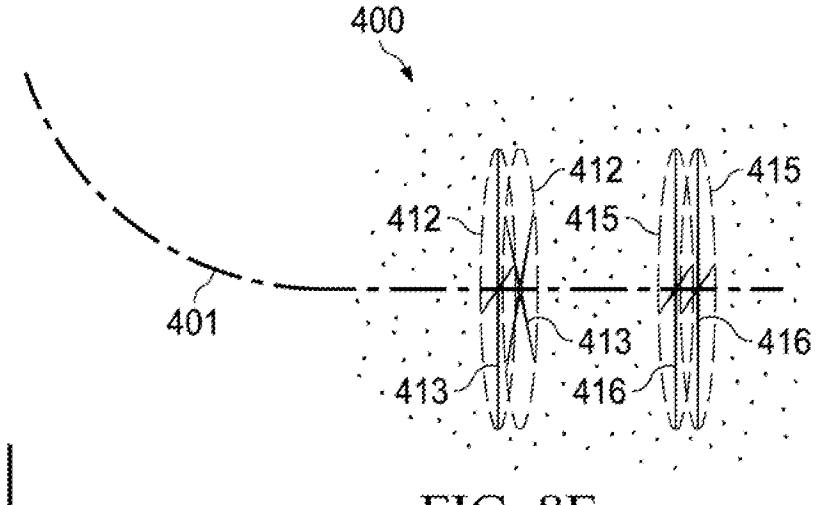

In FIGS. 8E and 8F a typical horizontal wellbore axis 401 is perforated. There are two closely spaced perforation planes 412 that are orthogonal to the wellbore axis 401. There are two additional closely spaced perforation planes 415 that are orthogonal to the wellbore axis 401. Each perforation plane 412 has four perforation jets 413. The perforation planes 412 are out of phase, resulting in the total of eight jets 413 perforating every 45 degrees about the wellbore 414. The perforation planes 415 are in phase, resulting in the two perforation jets 413 perforating every 90 degrees about the wellbore 414. FIG. 8F shows views of the perforation planes 412 and 415 with perforation jets 413 and 416 exiting the wellbore 414 and entering the formation 400.

Figure 8H:
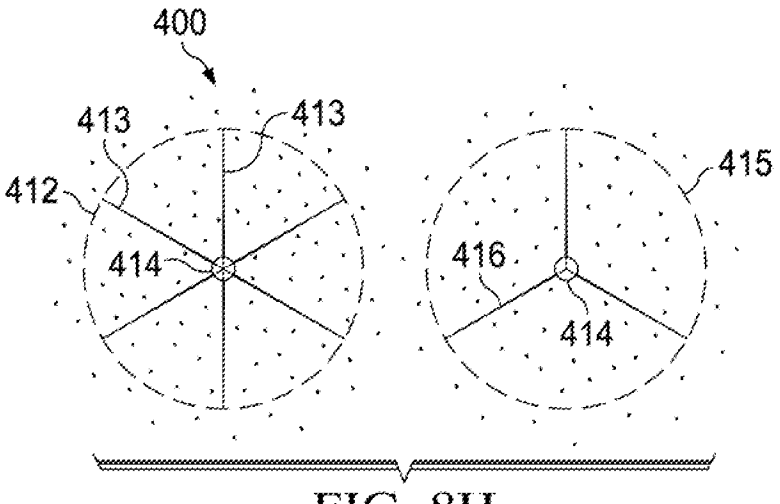
Figure 8G:
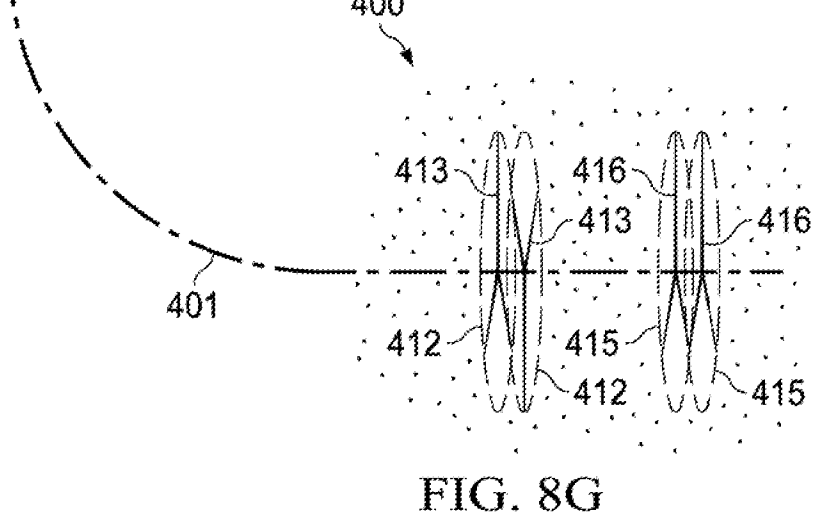

In FIGS. 8G and 8H a typical horizontal wellbore axis 401 is perforated. There are two closely spaced perforation planes 412 that are orthogonal to the wellbore axis 401. There are two additional closely spaced perforation planes 415 that are orthogonal to the wellbore axis 401. Each perforation plane 412 has three perforation jets 413. The perforation planes 412 are out of phase, resulting in the total of six perforation jets 413 perforating every 60 degrees about the wellbore 414. The perforation planes 412 are in phase, resulting in the total of two perforation jets 413 perforating every 120 degrees about the wellbore 414. FIG. 8H shows views of the perforation planes 412 and 415 with perforation jets 413 and 416 exiting the wellbore 414 and entering the formation 400. The number and orientation of cluster assemblies disclosed herein allow for a variety of combinations of perforation planes, number of perforations in each plane, the phasing of the perforation planes, and variability in the distance between each perforation plane.

The cluster assemblies disclosed allow for perforating in one or more separate radial planes. This provides a method for fracking an unconventional well by perforating a series of planes that do not necessarily intersect. A stimulation fluid is injected along with proppant and appropriate fracking fluids into the perforations. Fracking applies a hydrostatic pressure to the formation through the perforations, thus fracturing the formation substantially in the one or more radial perforation planes.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A method for perforating a well comprising:

combining a first cylindrical half with at least one shaped charge in a plane perpendicular to a center axis of the first cylindrical half;

enclosing the at least one shaped charge by combining a second cylindrical half longitudinally, along the center axis of the first cylindrical half, to the first cylindrical half, with the at least one shaped charge disposed between the first cylindrical half and second cylindrical half to form at least one cylindrical perforating shaped charge cluster;

installing the charge cluster into a perforating gun body;

coupling the perforating gun body to additional tubulars to form a tool string;

lowering the tool string into a first predetermined location within a wellbore; and detonating at least one charge cluster at the first predetermined location.

2. The method of claim 1, wherein the at least one shaped charge is a plurality of shaped charges.

3. The method of claim 1, wherein the at least one perforating shaped charge cluster is a plurality of charge clusters.

4. The method of claim 1, further comprising detonating at the least one charge cluster at a second predetermined location.

5. The method of claim 1, further comprising plugging the wellbore down hole from the first predetermined location.

6. The method of claim 1, further comprising plugging the wellbore down hole from the second predetermined location.

* * * * *